US011401569B2

(12) United States Patent
Tsuchihashi et al.

(10) Patent No.: US 11,401,569 B2
(45) Date of Patent: Aug. 2, 2022

(54) HIGH-STRENGTH COLD-ROLLED STEEL SHEET AND METHOD FOR MANUFACTURING SAME

(71) Applicant: JFE STEEL CORPORATION, Tokyo (JP)

(72) Inventors: Seigo Tsuchihashi, Tokyo (JP); Hidekazu Minami, Tokyo (JP); Takashi Kobayashi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 61 days.

(21) Appl. No.: 16/766,703

(22) PCT Filed: Oct. 29, 2018

(86) PCT No.: PCT/JP2018/040186

§ 371 (c)(1),
(2) Date: May 25, 2020

(87) PCT Pub. No.: WO2019/107042

PCT Pub. Date: Jun. 6, 2019

(65) Prior Publication Data

US 2020/0283862 A1 Sep. 10, 2020

(30) Foreign Application Priority Data

Nov. 29, 2017 (JP) ..... JP2017-229450

(51) Int. Cl.

| | |
|---|---|
| ***B32B 15/00*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/10*** | (2006.01) |
| ***C22C 38/12*** | (2006.01) |
| ***C22C 38/14*** | (2006.01) |
| ***C22C 38/20*** | (2006.01) |
| ***C22C 38/32*** | (2006.01) |
| ***C22C 38/60*** | (2006.01) |

(52) U.S. Cl.

CPC ..... *C21D 8/0236* (2013.01); *C21D 8/0226* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/105* (2013.01); *C22C 38/12* (2013.01); *C22C 38/14* (2013.01); *C22C 38/20* (2013.01); *C22C 38/32* (2013.01); *C22C 38/60* (2013.01); *C21D 2211/001* (2013.01); *C21D 2211/005* (2013.01); *C21D 2211/008* (2013.01)

(58) Field of Classification Search

CPC ..... C21D 8/0236; C21D 8/0226; C21D 9/46; C21D 2211/001; C21D 2211/005; C21D 2211/008; C22C 38/001; C22C 38/002; C22C 38/005; C22C 38/02; C22C 38/04; C22C 38/06; C22C 38/105; C22C 38/12; C22C 38/14; C22C 38/20; C22C 38/32; C22C 38/60; C22C 38/00

USPC ..... 148/651, 320; 420/8, 120

See application file for complete search history.

(56) References Cited

U.S. PATENT DOCUMENTS

| | | | |
|---|---|---|---|
| 8,815,026 | B2 | 8/2014 | Kaneko et al. |
| 8,876,987 | B2 | 11/2014 | Matsuda et al. |
| 10,156,005 | B2 | 12/2018 | Takashima et al. |
| 2008/0000555 | A1 | 1/2008 | Nonaka et al. |
| 2010/0218857 | A1 | 9/2010 | Nakagaito et al. |
| 2010/0314009 | A1* | 12/2010 | Kaneko et al. ..... C23C 2/28 148/553 |

(Continued)

FOREIGN PATENT DOCUMENTS

| | | | |
|---|---|---|---|
| CN | 101932742 | A | 12/2010 |
| CN | 103069040 | A | 4/2013 |

(Continued)

OTHER PUBLICATIONS

Jan. 22, 2019, International Search Report issued in the International Patent Application No. PCT/JP2018/040186.

Oct. 5, 2021, Office Action issued by the Korean Intellectual Property Office in the corresponding Korean Patent Application No. 10-2020-7017333 with English language concise statement of relevance.

Mar. 25, 2021, Office Action issued by the China National Intellectual Property Administration in the corresponding Chinese Patent Application No. 201880076594.0 with English language search report.

Ping Li, Collection of Excellent Papers on Academic Achievements of Natural Science in Anshan City in 2011, 2011, pp. 115-117.

*Primary Examiner* — Seth Dumbris

(74) *Attorney, Agent, or Firm* — Kenja IP Law PC

(57) ABSTRACT

Provided is a high-strength steel sheet having a tensile strength (TS) of 750 MPa or more and excellent in ductility and stretch flangeability, in which the steel sheet has a predetermined chemical composition and a microstructure containing, in area ratio, ferrite: 50% to 90%, quenched martensite: 1% to 8%, tempered martensite: 3% to 40%, and retained austenite: 6% to 15%, the quenched martensite has an average grain size of 2.5 μm or less, the quenched martensite has an average circularity index of 0.50 or more, the circularity index being defined as $4\pi M/D^2$, where D is a perimeter of the quenched martensite and M is an area of the quenched martensite, and the steel sheet has a ratio of an area ratio of the quenched martensite $f_M$ to a total area ratio of the quenched martensite and the tempered martensite $f_{M+TM}$, $f_M/f_{M+TM}$, of 50% or less.

4 Claims, No Drawings

(56) References Cited

U.S. PATENT DOCUMENTS

| | | | | |
|---|---|---|---|---|
| 2012/0132327 | A1* | 5/2012 | Mukai | C22C 38/14 148/660 |
| 2013/0133792 | A1 | 5/2013 | Nakagaito et al. | |
| 2016/0168656 | A1* | 6/2016 | Kawabe | C21D 8/0236 148/651 |
| 2017/0204491 | A1* | 7/2017 | Kawasaki | C21D 8/0278 |
| 2017/0218472 | A1* | 8/2017 | Kawasaki | C22C 38/002 |
| 2019/0003009 | A1* | 1/2019 | Kawata | C22C 38/002 |
| 2019/0062863 | A1 | 2/2019 | Tanaka et al. | |
| 2020/0071787 | A1* | 3/2020 | Natsumeda | C22C 38/14 |
| 2020/0248280 | A1 | 8/2020 | Minami et al. | |
| 2021/0340653 | A1* | 11/2021 | Kawata | C21D 9/48 |

FOREIGN PATENT DOCUMENTS

| | | | |
|---|---|---|---|
| CN | 105452513 | A | 3/2016 |
| JP | 2004308002 | A | 11/2004 |
| JP | 2006104532 | A | 4/2006 |
| JP | 2009102715 | A | 5/2009 |
| JP | 2009179852 | A | 8/2009 |
| JP | 2010196115 | A | 9/2010 |
| JP | 2015113504 | A | 6/2015 |
| KR | 101778643 | B1 | 9/2017 |
| WO | 2013051238 | A1 | 4/2013 |
| WO | 2017108866 | A1 | 6/2017 |
| WO | 2017141587 | A1 | 8/2017 |
| WO | 2017169562 | A1 | 10/2017 |

* cited by examiner

HIGH-STRENGTH COLD-ROLLED STEEL SHEET AND METHOD FOR MANUFACTURING SAME

TECHNICAL FIELD

This disclosure relates to a high-strength cold-rolled steel sheet, and in particular, a high-strength cold-rolled steel sheet excellent in ductility and stretch flangeability. This disclosure also relates to a method for manufacturing the same.

BACKGROUND

In recent years, demand for improvement of crashworthiness and fuel efficiency of automobiles has increased, and high strength steel has been increasingly applied. Since thin steel sheets for automobiles are formed into a desired shape on a cold-pressing process, high ductility is required. However, commonly, there is a trade-off between the strength and the ductility of a steel sheet, and thus, the improvement of ductility of a high strength steel sheet has been variously examined. In the process, using the transformation induced plasticity (TRIP) effect of retained austenite, a low alloy TRIP steel sheet has been developed and widely applied. However, since martensite formed by transformation of retained austenite of the TRIP steel sheet during working is excessively hard, and thus, easily acts as starting points of crack during formation of stretch flange, the TRIP steel sheet has low stretch flangeability.

To improve the low stretch flangeability, various studies have been conducted. For example, JP 2006-104532 A (PTL 1) describes a technique related to a steel sheet having ferrite as a matrix phase microstructure and tempered martensite, retained austenite, and bainite as a hard phase microstructure, excellent ductility and stretch flangeability, and a tensile strength of 528 MPa to 1445 MPa.

Further, WO 2013/051238 A (PTL 2) describes a technique related to a steel sheet containing tempered martensite, retained austenite, and bainite as a dominant, hard phase microstructure and a predetermined polygonal ferrite, and having excellent ductility and stretch flangeability and a tensile strength of 813 MPa to 1393 MPa.

CITATION LIST

Patent Literatures

PTL 1: JP 2006-104532 A
PTL 2: WO 2013/051238 A

SUMMARY

Technical Problem

Though even in the conventional steel sheets as described in PTL 1 and PTL 2, ductility and stretch flangeability are improved in some degree, there has been a demand for the development of a high-strength cold-rolled steel sheet having higher levels of ductility and stretch flangeability.

It could thus be helpful to provide a high-strength steel sheet having a tensile strength (TS) of 750 MPa or more and excellent in ductility and stretch flangeability. Further, it could also be helpful to provide a method for manufacturing the high-strength steel sheet. In this disclosure, "excellent in ductility" means that the product of TS and total elongation (El) (TS·El) is 20000 (MPa×%) or more. Further, in this disclosure, "excellent in stretch flangeability" means that the product of TS and hole expansion ratio (λ) (TS·λ) is 30000 (MPa×%) or more.

Solution to Problem

The inventors made intensive studies to obtain a high-strength steel sheet having a tensile strength of 750 MPa or more and excellent in ductility and stretch frangeability, and as a result made the following discoveries.

(1) The circularity index of quenched martensite can be controlled by controlling the steel slab heating temperature, the finisher delivery temperature, the coiling temperature, the cold rolling reduction ratio, and the heating rate to a first soaking temperature.

(2) The area ratio of ferrite in the microstructure after annealing can be controlled by controlling the first soaking temperature for obtaining a ferrite-austenite dual phase and the average cooling rate from the first soaking temperature to 500° C.

(3) The area ratios of tempered martensite, quenched martensite, and retained austenite in the microstructure after annealing can be controlled by controlling the cooling stop temperature, the cooling rate, and the soaking temperature during a process in which cooling is performed to a martensite transformation start temperature or lower on the cooling process and subsequently the temperature is raised to a temperature range in which upper bainite is formed to perform soaking treatment.

(4) The area ratio of quenched martensite to the total area ratio of quenched martensite and tempered martensite can be controlled by controlling the cooling rate to 200° C. in a final cooling process to room temperature after the soaking treatment at the temperature range in which upper bainite is formed.

(5) A steel sheet having TS of 750 MPa or more and excellent in ductility and stretch flangeability can be obtained by controlling manufacturing conditions on each process in the specific ranges.

This disclosure is based on the findings described above and has the following primary features.

1. A high-strength cold-rolled steel sheet comprising: a chemical composition containing (consisting of), in mass %, C: 0.060% to 0.250%,
Si: 0.70% to 1.80%,
Mn: 1.00% to 2.80%,
P: 0.100% or less,
S: 0.0100% or less,
Al: 0.010% to 0.100%, and
N: 0.0100% or less, with the balance being Fe and inevitable impurities, wherein the high-strength cold-rolled steel sheet has a microstructure containing, in area ratio, ferrite: 50% to 90%,
quenched martensite: 1% to 8%,
tempered martensite: 3% to 40%, and
retained austenite: 6% to 15%, the quenched martensite has an average grain size of 2.5 μm or less, the quenched martensite has an average circularity index of 0.50 or more, the circularity index being defined as $4\pi M/D^2$, where D is a perimeter of the quenched martensite and M is an area of the quenched martensite, and the high-strength cold-rolled steel sheet has a ratio of an area ratio of the quenched martensite $f_M$ to a total area ratio of the quenched martensite and the tempered martensite $f_{M+TM}$, $f_M/f_{M+TM}$, of 50% or less.

2. The high-strength cold-rolled steel sheet according to 1., wherein the chemical composition further contains, in mass %, at least one selected from the group consisting of:

Mo: 0.50% or less,
Ti: 0.100% or less,
Nb: 0.050% or less,
V: 0.100% or less,
B: 0.0100% or less,
Cr: 0.50% or less,
Cu: 1.00% or less,
Ni: 0.50% or less,
As: 0.500% or less,
Sb: 0.100% or less,
Sn: 0.100% or less,
Ta: 0.100% or less,
Ca: 0.0200% or less,
Mg: 0.0200% or less,
Zn: 0.020% or less,
Co: 0.020% or less,
Zr: 0.020% or less, and
REM: 0.0200% or less.

3. A method for manufacturing a high-strength cold-rolled steel sheet, comprising:

heating a steel slab having the chemical composition according to 1. or 2. to a steel slab heating temperature of 1100° C. to 1300° C. to obtain a heated steel slab, hot rolling the heated steel slab with a finisher delivery temperature of 800° C. to 950° C., a coiling temperature of 300° C. to 700° C. to obtain a hot-rolled steel sheet, cold rolling the hot-rolled steel sheet with a rolling reduction of 30% or more to obtain a cold-rolled steel sheet, subjecting the cold-rolled steel sheet to a first soaking treatment, whereby the cold-rolled steel sheet is heated under conditions of a first soaking temperature of a T1 temperature or higher and a T2 temperature or lower and an average heating rate of less than 5.0° C./s within a temperature range of 500° C. to an $Ac_1$ transformation temperature and subsequently cooled to a cooling stop temperature of 100° C. to 250° C. with an average cooling rate of 10° C./s or more in a temperature range down to 500° C., and subjecting the cold-rolled steel sheet after the first soaking treatment to a second soaking treatment, whereby the cold-rolled steel sheet is re-heated to a second soaking temperature of 350° C. to 500° C., held at the second soaking temperature for 10 seconds or more, subsequently cooled to 200° C. with an average cooling rate of 50° C./s or less, and then cooled to a room temperature, the T1 temperature being defined by the following formula (1):

$$T1\ \text{temperature}\ (^\circ\ \text{C.})=751-27\times[\%\ \text{C}]+18\times[\%\ \text{Si}]-12\times[\%\ \text{Mn}]-169\times[\%\ \text{Al}]-6\times[\%\ \text{Ti}]+24\times[\%\ \text{Cr}]-895\times[\%\ \text{B}] \quad (1)$$

the T2 temperature being defined by the following formula (2):

$$T2\ \text{temperature}\ (^\circ\ \text{C.})=937-477\times[\%\ \text{C}]+56\times[\%\ \text{Si}]-20\times[\%\ \text{Mn}]+198\times[\%\ \text{Al}]+136\times[\%\ \text{Ti}]-5\times[\%\ \text{Cr}]+3315\times[\%\ \text{B}] \quad (2)$$

where brackets of the formula (1) and formula (2) indicate content by mass % of an element of the chemical composition enclosed in the brackets.

Advantageous Effect

According to this disclosure, it is possible to obtain a high-strength steel sheet having a tensile strength (TS) of 750 MPa or more and excellent in ductility and stretch flangeability. Further, high-strength steel sheets according to this disclosure are highly beneficial in industrial terms because, for example, they can improve fuel efficiency through a reduction in the weight of automotive bodies when applied to automobile structural parts.

DETAILED DESCRIPTION

Next, a detailed description is given below.

[Chemical Composition]

In this disclosure, a high-strength cold-rolled steel sheet and a steel slab used for manufacturing the same need to have the above-described chemical composition. Reasons for the limitations of the chemical composition in this disclosure will now be described. In the description of the chemical composition, "%" denotes "mass %" unless otherwise noted.

C: 0.060% to 0.250%

C is one of basic components of steel. C contributes to the formation of a hard phase in the high-strength cold-rolled steel sheet of this disclosure, that is, the formation of tempered martensite, retained austenite, and quenched martensite, and in particular, affects the area ratios of quenched martensite and retained austenite. The mechanical properties such as strength of the resulting high-strength cold-rolled steel sheet highly depend on the area ratio, shape, and average size of quenched martensite, and thus, the control of the C content is important. When the C content is less than 0.060%, necessary area ratios of quenched martensite, tempered martensite, and retained austenite cannot be ensured, and thus it is difficult to ensure the strength of the steel sheet. Therefore, the C content is set to 0.060% or more, preferably 0.070% or more, and more preferably 0.080% or more. On the other hand, when the C content is more than 0.250%, the proportion of tempered martensite is decreased, thus lowering ductility and stretch flangeability. Therefore, the C content is set to 0.250% or less, preferably 0.220% or less, and more preferably 0.200% or less.

Si: 0.70% to 1.80%

Si is an important element which suppresses the formation of carbides during bainite transformation to thereby form retained austenite and contributes to improved ductility. To form a necessary area ratio of retained austenite, the Si content needs to be 0.70% or more. Therefore, the Si content is set to 0.70% or more, preferably 0.90% or more, and more preferably 1.00% or more. On the other hand, when the Si content is more than 1.80%, the amount of austenite formed during bainite transformation is increased, that is, the amount of retained austenite which transforms to martensite during punching is increased, which increases origins of cracks during a hole expanding test, and thus stretch flangeability is lowered. Therefore, the Si content is set to 1.80% or less, preferably 1.60% or less, and more preferably 1.50% or less.

Mn: 1.00% to 2.80%

Since Mn is an element which stabilizes austenite and contributes to the control of the area ratio of a hard phase, Mn is an important element for ensuring the strength. To achieve this effect, the Mn content needs to be 1.00% or more. Therefore, the Mn content is set to 1.00% or more, preferably 1.30% or more, and more preferably 1.50% or more. On the other hand, when Mn is contained excessively, the area ratio of quenched martensite is excessively increased, and the stretch flangeability decreases although the tensile strength increases. Thus, the Mn content needs to be 2.80% or less. Therefore, the Mn content is set to 2.80% or less, preferably 2.70% or less, and more preferably 2.60% or less.

P: 0.100% or Less

Since when the P content is more than 0.100%, P segregates at ferrite grain boundaries or at interfaces between ferrite and quenched martensite to embrittle the grain boundaries, local elongation is reduced, and ductility and stretch flangeability are lowered. Therefore, the P content is set to 0.100% or less, and preferably 0.050% or less. On the other hand, though no lower limit is placed on the P content, P has an effect of solid solution strengthening, and thus, from the viewpoint of improving the strength of the steel sheet, the P content is preferably set to 0.001% or more.

S: 0.0100% or Less

S is an element which forms sulfides such as MnS to lower local deformability and thus lowers ductility and stretch flangeability. Therefore, the S content is set to 0.0100% or less, and preferably 0.0050% or less. Therefore, though no lower limit is placed on the S content, under production constraints, the S content is preferably set to 0.0001% or more, and more preferably 0.0001% or more.

Al: 0.010% to 0.100%

Al is an element which suppresses the formation of carbides to thereby contribute to the formation of retained austenite. To obtain this effect, the Al content needs to be 0.010% or more. Therefore, the Al content is set to 0.010% or more, and preferably 0.020% or more. On the other hand, when the Al content is more than 0.100%, the amount of austenite formed during bainite transformation is increased, that is, the amount of retained austenite which transforms to martensite during punching is increased, which increase origins of cracks during a hole expanding test, and thus stretch flangeability is lowered. Therefore, the Al content is set to 0.100% or less, and preferably 0.070% or less.

N: 0.0100% or Less

Since N forms nitrides and lowers the ultimate deformability of the steel sheet, N lowers ductility and stretch flangeability. Therefore, the N content is set to 0.0100% or less, and preferably 0.0070% or less. On the other hand, though no lower limit is placed on the N content, under production constraints, the N content is preferably set to 0.0005% or more.

A high-strength cold-rolled steel sheet of one embodiment of this disclosure has a chemical composition containing the above components with the balance being Fe and inevitable impurities. Specifically, the high-strength cold-rolled steel sheet of one embodiment of this disclosure may have a chemical composition containing, in mass %, C: 0.060% to 0.250%,
Si: 0.70% to 1.80%,
Mn: 1.00% to 2.80%,
P: 0.100% or less,
S: 0.0100% or less,
Al: 0.010% to 0.100%,
N: 0.0100% or less, and
with the balance being Fe and inevitable impurities.

Further, for a high-strength cold-rolled steel sheet of another embodiment of this disclosure, the chemical composition can further include, in addition to the above elements, at least one selected from the element group described below.

Mo: 0.50% or Less

Mo is an element which improves quench hardenability and is effective for properly controlling the proportion of tempered martensite and quenched martensite through suppression of the formation of ferrite during cooling after annealing. However, when Mo is contained excessively, inclusions are increased, lowering ductility and stretch flangeability. Therefore, in the case of adding Mo, the Mo content is set to 0.50% or less. On the other hand, no lower limit is placed on the Mo content, yet from the viewpoint of sufficiently obtaining the effect of adding Mo, the Mo content is preferably set to 0.01% or more.

Ti: 0.100% or Less

Ti forms fine carbonitrides by combining with C and N which cause aging deterioration and contributes to the improved strength. Further, through addition of Ti, recrystallization temperature in a heating process of continuous annealing is increased, which makes it possible to nucleate uniform and fine austenite from a deformed microstructure during annealing. Therefore, the average crystal grain size and the circularity index of quenched martensite can be properly controlled and the stretch flangeability can be improved. However, when the Ti content is more than 0.100%, inclusions such as carbonitrides are excessively formed, thus lowering ductility and stretch flangeability. Therefore, when Ti is added, the Ti content is set to 0.100% or less and preferably 0.050% or less. On the other hand, no lower limit is placed on the Ti content, yet from the viewpoint of sufficiently obtaining the effect of adding Ti, the Ti content is preferably set to 0.001% or more and more preferably 0.005% or more.

Nb: 0.050% or Less

Nb forms fine carbonitrides by combining with C and N which cause aging deterioration and contributes to the improved strength. Further, through addition of Nb, recrystallization temperature in a heating process of continuous annealing is increased, which makes it possible to nucleate uniform and fine austenite from a deformed microstructure during annealing. Therefore, the average crystal grain size and the circularity index of quenched martensite can be properly controlled and the stretch flangeability can be improved. However, when the Nb content is more than 0.050%, inclusions such as carbonitrides are excessively formed, thus lowering ductility and stretch flangeability. Therefore, in the case of adding Nb, the Nb content is set to 0.050% or less. On the other hand, no lower limit is placed on the Nb content, yet from the viewpoint of sufficiently obtaining the effect of adding Nb, the Nb content is preferably set to 0.001% or more.

V: 0.100% or Less

V forms fine carbonitrides by combining with C and N which cause aging deterioration and contributes to the improved strength. Further, through addition of V, recrystallization temperature in a heating process of continuous annealing is increased, which makes it possible to nucleate uniform and fine austenite from a deformed microstructure during annealing. Therefore, the average crystal grain size and the circularity index of quenched martensite can be properly controlled and the stretch flangeability can be improved. However, when the V content is more than 0.100%, inclusions such as carbonitrides are excessively formed, thus lowering ductility and stretch flangeability. Therefore, in the case of adding V, the V content is set to 0.100% or less. On the other hand, no lower limit is placed on the V content, yet from the viewpoint of sufficiently obtaining the effect of adding V, the V content is preferably set to 0.001% or more.

B: 0.0100% or Less

B improves quench hardenability and makes it easy to produce a hard phase to thereby contribute to strengthening. However, when the B content is more than 0.0100%, cracks are formed inside of the steel sheet during hot rolling, which lowers the ultimate deformability of the steel sheet, and thus, ductility and stretch flangeability are lowered. Therefore, in the case of adding B, the B content is set to 0.0100% or less. On the other hand, no lower limit is placed on the B content, yet from the viewpoint of sufficiently obtaining the effect of adding B, the B content is preferably set to 0.0001% or more.

Cr: 0.50% or Less

Cr is an element which achieves solid-solution-strengthening and promotes the formation of a hard phase to thereby contribute to strengthening. However, when the Cr content is more than 0.50%, a large number of coarse precipitates and inclusions are formed, which lowers the ultimate deformability of the steel sheet, and thus, ductility and stretch flangeability are lowered. Therefore, in the case of adding Cr, the Cr content needs to be 0.50% or less. On the other hand, no lower limit is placed on the Cr content, yet from the viewpoint of sufficiently obtaining the effect of adding Cr, the Cr content is preferably set to 0.01% or more.

Cu: 1.00% or Less

Cu is an element which achieves solid-solution strengthening and promotes the formation of a hard phase to thereby contribute to strengthening. However, when the Cu content is more than 1.00%, a large number of coarse precipitates and inclusions are formed, which lowers the ultimate deformability of the steel sheet, and thus, ductility and stretch flangeability are lowered. Therefore, in the case of adding Cu, the Cu content is set to 1.00% or less. On the other hand, no lower limit is placed on the Cu content, yet from the viewpoint of sufficiently obtaining the effect of adding Cu, the Cu content is preferably set to 0.01% or more.

Ni: 0.50% or Less

Ni is an element which achieves solid-solution-strengthening, improves quench hardenability, and promotes the formation of a hard phase to thereby contribute to strengthening. However, when the Ni content is more than 0.50%, surface defects and internal defects caused by the increase of inclusions or the like lower ductility and stretch flangeability. Therefore, in the case of adding Ni, the Ni content is set to 0.50% or less. On the other hand, no lower limit is placed on the Ni content, yet from the viewpoint of sufficiently obtaining the effect of adding Ni, the Ni content is preferably set to 0.01% or more.

As: 0.500% or Less

As is an element which contributes to improved corrosion resistance. However, when the As content is more than 0.500%, surface defects and internal defects caused by the increase of inclusions or the like lower ductility. Therefore, in the case of adding As, the As content is set to 0.500% or less. On the other hand, no lower limit is placed on the As content, yet from the viewpoint of sufficiently obtaining the effect of adding As, the As content is preferably set to 0.001% or more.

Sb: 0.100% or Less

Sb is an element which is concentrated in a surface of the steel sheet and suppresses decarburization caused by nitridation and oxidation of the steel sheet surface to suppress the reduction of the C content on a surface layer, and thus promotes the formation of a hard phase to contribute to strengthening. However, when the Sb content is more than 0.100%, coarse precipitates and inclusions are increased, which lowers the ultimate deformability of the steel sheet, and thus, ductility and stretch flangeability are lowered. Therefore, in the case of adding Sb, the Sb content is set to 0.100% or less. On the other hand, no lower limit is placed on the Sb content, yet from the viewpoint of sufficiently obtaining the effect of adding Sb, the Sb content is preferably set to 0.001% or more.

Sn: 0.100% or Less

Sn is an element which is concentrated in a surface of the steel sheet and suppresses decarburization caused by nitridation and oxidation of the steel sheet surface to suppress the reduction of the C content on a surface layer, and thus promotes the formation of a hard phase to contribute to strengthening. However, when the Sn content is more than 0.100%, coarse precipitates and inclusions are increased, which lowers the ultimate deformability of the steel sheet, and thus, ductility and stretch flangeability are lowered. Therefore, in the case of adding Sn, the Sn content is 0.100% or less. On the other hand, no lower limit is placed on the Sn content, yet from the viewpoint of sufficiently obtaining the effect of adding Sn, the Sn content is preferably set to 0.001% or more.

Ta: 0.100% or Less

Ta forms fine carbonitrides by combining with C and N as with Ti and Nb and contributes to improved strength. Further, Ta is partially dissolved in Nb carbonitrides and suppresses coarsening of precipitates to contribute to improved local ductility. However, when the Ta content is more than 0.100%, inclusions such as carbonitrides are excessively formed, which reduces the ultimate deformability of the steel sheet, and thus ductility and stretch flangeability are lowered. Therefore, in the case of adding Ta, the Ta content is set to 0.100% or less. On the other hand, no lower limit is placed on the Ta content, yet from the viewpoint of sufficiently obtaining the effect of adding Ta, the Ta content is preferably set to 0.001% or more.

Ca: 0.0200% or Less

Ca contributes to improved ultimate deformability of the steel sheet through spheroidization of sulfides. However, when the Ca content is more than 0.0200%, a large number of coarse precipitates and inclusions are formed, which lowers the ultimate deformability of the steel sheet, and thus, ductility and stretch flangeability are lowered. Therefore, in the case of adding Ca, the Ca content is set to 0.0200% or less. On the other hand, no lower limit is placed on the Ca content, yet from the viewpoint of sufficiently obtaining the effect of adding Ca, the Ca content is preferably set to 0.0001% or more.

Mg: 0.0200% or Less

Mg contributes to improved ultimate deformability of the steel sheet through spheroidization of sulfides as with Ca. However, when the Mg content is more than 0.0200%, a large number of coarse precipitates and inclusions are formed, which lowers the ultimate deformability of the steel sheet, and thus, ductility and stretch flangeability are lowered. Therefore, in the case of adding Mg, the Mg content is set to 0.0200% or less. On the other hand, no lower limit is placed on the Mg content, yet from the viewpoint of sufficiently obtaining the effect of adding Mg, the Mg content is preferably set to 0.0001% or more.

Zn: 0.020% or Less

Zn contributes to improved ultimate deformability of the steel sheet through spheroidization of sulfides as with Ca and Mg. However, when the Zn content is more than 0.020%, a large number of coarse precipitates and inclusions are formed, which lowers the ultimate deformability of the steel sheet, and thus, ductility and stretch flangeability are lowered. Therefore, in the case of adding Zn, the Zn content is 0.020% or less. On the other hand, no lower limit is placed on the Zn content, yet from the viewpoint of sufficiently obtaining the effect of adding Zn, the Zn content is preferably set to 0.001% or more.

Co: 0.020% or Less

Co contributes to improved ultimate deformability of the steel sheet through spheroidization of sulfides as with Zn. However, when the Co content is more than 0.020%, a large number of coarse precipitates and inclusions are formed, which lowers the ultimate deformability of the steel sheet, and thus, ductility and stretch flangeability are lowered. Therefore, in the case of adding Co, the Co content is set to 0.020% or less. On the other hand, no lower limit is placed on the Co content, yet from the viewpoint of sufficiently obtaining the effect of adding Co, the Co content is preferably set to 0.001% or more.

Zr: 0.020% or Less

Zr contributes to improved ultimate deformability of the steel sheet through spheroidization of sulfides as with Zn and Co. However, when the Zr content is more than 0.020%, a large number of coarse precipitates and inclusions are formed, which lowers the ultimate deformability of the steel sheet, and thus, ductility and stretch flangeability are lowered. Therefore, in the case of adding Zr, the Zr content is set to 0.020% or less. On the other hand, no lower limit is placed on the Zr content, yet from the viewpoint of sufficiently obtaining the effect of adding Zr, the Zr content is preferably set to 0.001% or more.

REM: 0.0200% or Less

REM (rare-earth metal) contributes to improved ultimate deformability of the steel sheet through spheroidization of sulfides. However, when the REM content is more than 0.0200%, a large number of coarse precipitates and inclusions are formed, which lowers the ultimate deformability of the steel sheet, and thus, ductility and stretch flangeability are lowered. Therefore, in the case of adding REM, the REM content is set to 0.0200% or less. On the other hand, no lower limit is placed on the REM content, yet from the viewpoint of sufficiently obtaining the effect of adding REM, the REM content is preferably set to 0.0001% or more.

Specifically, the high-strength cold-rolled steel sheet of another embodiment of this disclosure can have a chemical composition containing, in mass %, C: 0.060% to 0.250%,
Si: 0.70% to 1.80%,
Mn: 1.00% to 2.80%,
P: 0.100% or less,
S: 0.0100% or less,
Al: 0.010% to 0.100%,
N: 0.0100% or less, optionally, at least one selected from the group consisting of Mo: 0.50% or less,
Ti: 0.100% or less,
Nb: 0.050% or less,
V: 0.100% or less,
B: 0.0100% or less,
Cr: 0.50% or less,
Cu: 1.00% or less,
Ni: 0.50% or less,
As: 0.500% or less,
Sb: 0.100% or less,
Sn: 0.100% or less,
Ta: 0.100% or less,
Ca: 0.0200% or less,
Mg: 0.0200% or less,
Zn: 0.020% or less,
Co: 0.020% or less,
Zr: 0.020% or less, and
REM: 0.0200% or less with the balance being Fe and inevitable impurities.

[Microstructure]

Next, reasons for restricting the microstructure in the high-strength cold-rolled steel sheet of this disclosure as described above are explained. In the description of the microstructure, "%" denotes "area ratio" unless otherwise noted.

Ferrite: 50% to 90%

When the area ratio of ferrite is less than 50%, soft ferrite is little and thus elongation is lowered. Therefore, the area ratio of ferrite is set to 50% or more and preferably 55% or more. On the other hand, when the area ratio of ferrite is more than 90%, C expelled from a ferrite phase is excessively concentrated on a hard phase, which makes it difficult to form tempered martensite. As a result, the area ratio of quenched martensite to the total area ratio of quenched martensite and tempered martensite is increased, and as a result, stretch flangeability is lowered. Therefore, the area ratio of ferrite is set to 90% or less, and preferably 85% or less. Note that in this disclosure, ferrite includes bainitic ferrite.

Quenched Martensite: 1% to 8%

When the area ratio of quenched martensite is less than 1%, the area ratio of tempered martensite in a hard phase is increased. Therefore, the area ratio of quenched martensite is set to 1% or more and preferably 2% or more. On the other hand, when the area ratio of quenched martensite is more than 8%, the area ratio of quenched martensite to the total area ratio of quenched martensite and tempered martensite is increased, thus lowering stretch flangeability. Therefore, the area ratio of quenched martensite is set to 8% or less and preferably 6% or less.

Tempered Martensite: 3% to 40%

To ensure good stretch flangeability, the ratio of the area ratio of tempered martensite to the total area ratio of quenched martensite and tempered martensite needs to be at least a predetermined ratio. Therefore, the area ratio of tempered martensite is set to 3% or more and preferably 6% or more. On the other hand, when the area ratio of tempered martensite is more than 40%, the area ratio of ferrite is decreased, thus lowering TS. Therefore, the area ratio of tempered martensite is set to 40% or less and preferably 35% or less.

Tempered martensite has a form in which carbides precipitate in a fine ferrite matrix having high-density lattice defects such as dislocation and resembles bainite. Thus, tempered martensite cannot be distinguished from bainite. Therefore, in this disclosure, tempered martensite includes bainite.

Retained Austenite: 6% to 15%

When the area ratio of retained austenite is less than 6%, elongation is lowered. Therefore, to ensure good elongation, the area ratio of retained austenite is set to 6% or more and preferably 8% or more. On the other hand, when the area ratio of retained austenite is more than 15%, the amount of retained austenite which transforms to martensite during punching is increased, which increases origins of cracks during a hole expanding test, and thus stretch flangeability is lowered. Therefore, the area ratio of retained austenite is set to 15% or less, and preferably 13% or less.

The microstructure preferably contains, in area ratio, ferrite: 50% to 90%,
quenched martensite: 1% to 8%,
tempered martensite: 3% to 40%, and
retained austenite: 6% to 15%.

Average Grain Size of Quenched Martensite: 2.5 μm or Less

When the average grain size of quenched martensite is more than 2.5 μm, quenched martensite easily becomes origins of cracks during punching, thus lowering stretch flangeability. Therefore, the average grain size is set to 2.5 μm or less, and preferably 2.0 μm or less. On the other hand, no lower limit is placed on the average grain size of quenched martensite. However, when the average grain size of quenched martensite is 0.4 μm or more, the increase of the area ratio of tempered martensite in a hard phase can be suppressed. Therefore, from the viewpoint of further improving TS, the average grain size of quenched martensite is preferably set to 0.4 μm or more and more preferably 0.6 μm or more.

Average Circularity Index of Quenched Martensite: 0.50 or More

This is a very important feature in this disclosure. Quenched martensite has an average circularity index (hereinafter, referred to simply as "circularity index of quenched martensite") of 0.50 or more, the circularity index being defined as $4\pi M/D^2$, where D is a perimeter of the quenched martensite and M is an area of the quenched martensite. The circularity index is an index which represents the shape of a quenched martensite grain and has a close relationship with stretch flangeability. The circularity index takes a value of more than 0 to 1. As the shape of the grain is closer to a circle, the circularity index is close to 1 which is the maximum value, and as the shape of the grain is more intricate and more complicated, the circularity index becomes small to be close to 0. When quenched martensite has a circularity index of less than 0.5, quenched martensite having a complicated shape is formed and strains introduced during punching are non-uniformly dispersed in the quenched martensite, which easily causes voids. As a result, stretch flangeability is lowered, and thus, the circularity index is set to 0.50 or more, preferably 0.55 or more, and more preferably 0.60 or more. On the other hand, the circularity index is preferable as high (close to 1) as possible, and thus, no upper limit is placed on it.

Ratio of Area Ratio of Quenched Martensite $f_M$ to Total Area Ratio of Quenched Martensite and Tempered Martensite $f_{M+TM}$, $f_M/f_{M+TM}$: 50% or Less To obtain a steel sheet having high strength and high stretch flangeability, the area ratio of quenched martensite to the total area ratio of quenched martensite and tempered martensite needs to be controlled. Specifically, decreasing $f_M/f_{M+TM}$, that is, decreasing the proportion of quenched martensite is necessary. The ratio of the area ratio of quenched martensite $f_M$ to the total area ratio of quenched martensite and tempered martensite $f_{M+TM}$, $f_M/f_{M+TM}$, has a close relationship with stretch flangeability. When $f_M/f_{M+TM}$ is higher than 50%, the area ratio of quenched martensite to the total area ratio of quenched martensite and tempered martensite is increased, and thus, stretch flangeability is lowered. Therefore, $f_M/f_{M+TM}$ is set to 50% or less, preferably 45% or less, and more preferably 40% or less. Satisfying the above conditions is very important in this disclosure.

[Sheet Thickness]

The sheet thickness of the high-strength cold-rolled steel sheet in this disclosure is not particularly limited, yet a standard sheet thickness of a thin sheet, 0.8 mm to 2.0 mm is preferable.

[Manufacturing Method]

Next, a method for manufacturing a high-strength cold-rolled steel sheet of this disclosure will be described.

The high-strength cold-rolled steel sheet of this disclosure can be manufactured by subjecting a steel slab having the above chemical composition to the following treatments in sequence.

(1) Heating to a steel slab heating temperature of 1100° C. to 1300° C.

(2) Hot rolling (2-1) Rolling with a finisher delivery temperature of 800° C. to 950° C.

(2-2) Coiling with a coiling temperature of 300° C. to 700° C.

(3) Cold rolling (4) First soaking treatment (4-1) Heating to a first soaking temperature of a T1 temperature or more and a T2 temperature or less (4-2) Cooling to a cooling stop temperature of 100° C. to 250° C. with an average cooling rate of 10° C./s or more in a temperature range down to 500° C.

(5) Second soaking treatment (5-1) Re-heating to a second soaking temperature of 350° C. to 500° C.

(5-2) Holding for 10 seconds or more (5-3) Cooling with an average cooling rate of 50° C./s or less in a temperature range down to 200° C.

(5-4) Cooling to a room temperature

The reasons for limiting conditions in each step are described below.

[Steel Slab]

In this disclosure, a steel slab having the above chemical composition is used as a raw material. The steel slab can be manufactured by any method. For example, the steel slab can be manufactured by preparing molten steel having the above chemical composition by steelmaking with a conventional method and subjecting the molten steel to casting. The steelmaking can be performed by any method using a converter, an electric heating furnace, and the like. The steel slab is preferably manufactured with continuous casting to prevent macro segregation but may be manufactured with other methods such as ingot casting or thin slab casting.

[Heating]

Steel Slab Heating Temperature: 1100° C. to 1300° C.

Before hot rolling, the steel slab is heated to a steel slab heating temperature. The steel slab heating temperature is a factor which affects ductility and stretch flangeabiligy. When the steel slab heating temperature is lower than 1100° C., coarse precipitates are formed, lowering ductility and stretch flangeability. Further, since the resulting steel sheet has a microstructure elongated in a rolling direction, the circularity index of quenched martensite is decreased, lowering stretch flangeability. Therefore, the steel slab heating temperature is set to 1100° C. or higher. On the other hand, when the steel slab heating temperature is higher than 1300° C., scale loss caused by the increase of the amount of oxidation increases. Therefore, the steel slab heating temperature is set to 1300° C. or lower.

In the heating step, the steel slab thus manufactured may be cooled to room temperature and then heated again according to the conventional method. Alternatively, energy-saving processes, such as hot direct rolling or direct rolling in which either a warm steel slab without being fully cooled to room temperature is charged into a heating furnace, or a steel slab is held at a constant temperature for a short period and immediately hot rolled, can be employed without problems.

[Hot Rolling]

Then, the heated slab is hot rolled to obtain a hot-rolled steel sheet. The hot-rolling step includes rolling of the steel slab and coiling of the rolled steel sheet.

Finisher Delivery Temperature: 800° C. to 950° C.

In the hot-rolling step, it is necessary to finish rolling in an austenite single phase region to make the microstructure of the steel sheet uniform and decrease anisotropy in the material property. When the finisher delivery temperature is lower than 800° C., the resulting steel sheet has a microstructure elongated in a rolling direction. Thus, the circularity index of quenched martensite is decreased, lowering stretch flangeability. Therefore, the finisher delivery temperature is set to 800° C. or higher. On the other hand, when the finisher delivery temperature is higher than 950° C., the crystal grain size of ferrite included in the steel microstructure of the hot-rolled steel sheet is coarsened, and thus, the nucleation site of austenite during annealing is decreased, that is, the area ratios of quenched martensite, tempered martensite, and retained austenite are decreased, lowering the strength. Therefore, the finisher delivery temperature is set to 950° C. or lower.

The rolling may include rough rolling and finish rolling according to the conventional method. The steel slab is subjected to rough rolling and formed into a sheet bar. For example, when the heating temperature is set relatively low, the sheet bar is preferably heated using a bar heater or the like prior to finish rolling from the viewpoint of preventing troubles during hot rolling.

Coiling Temperature: 300° C. to 700° C.

Next, the finish-rolled steel sheet is coiled. At that time, when the coiling temperature is higher than 700° C., the crystal grain size of ferrite included in the steel microstructure of the hot-rolled steel sheet is coarsened, the nucleation site of austenite during annealing is decreased, that is, the area ratios of quenched martensite, tempered martensite, and retained austenite are decreased, which makes it difficult to ensure a desired strength after annealing. Therefore, the coiling temperature is set to 700° C. or lower. On the other hand, when the coiling temperature is lower than 300° C., there is an increase in the strength of the hot-rolled sheet and in the rolling load in the subsequent cold rolling step, degrading productivity. When a hard hot-rolled sheet having a martensite-dominant microstructure is subjected to cold rolling, minute internal cracking (brittle cracking) easily occurs along prior austenite grain boundaries in martensite, degrading the ductility and stretch flangeability of an annealed sheet. Further, since the resulting steel sheet has a microstructure elongated in a rolling direction, the circularity index of quenched martensite is decreased, lowering stretch flangeability. Therefore, the coiling temperature is set to 300° C. or higher.

[Descaling]

The coiled hot-rolled steel sheet is uncoiled and subjected to the cold rolling step described below, yet before the cold rolling, descaling is preferably performed. Scales on a surface layer of the steel sheet can be removed by the descaling. The descaling can be performed with any method such as pickling and grinding, yet preferably performed by pickling. The pickling has no particularly limited conditions and may be performed with a conventional method.

[Cold Rolling]

Next, the descaled hot-rolled steel sheet is cold rolled to obtain a cold-rolled steel sheet.

Rolling Reduction During Cold Rolling: 30% or More

When the rolling reduction during the cold rolling is less than 30%, the total number of grain boundaries and dislocations that act as nuclei for reverse transformation to austenite per unit volume is decreased during the subsequent annealing, making it difficult to uniformly nucleate austenite. As a result, since the resulting steel sheet has an elongated microstructure, the circularity index of quenched martensite is decreased, lowering stretch flangeability. Therefore, the rolling reduction during the cold rolling is set to 30% or more, preferably 35% or more, and more preferably 40% or more. The effect of this disclosure can be obtained without limiting the number of rolling passes or the rolling reduction for each pass. No upper limit is placed on the rolling reduction, yet the rolling reduction is preferably set to 80% or less in industrial terms.

[First Soaking Treatment]

Then, the cold-rolled steel sheet obtained through the cold rolling step is subjected to a first soaking treatment. The first soaking treatment includes heating to a first soaking temperature and cooling to a cooling stop temperature.

Average Heating Rate within a Temperature Range of 500° C. to $Ac_1$ Transformation Temperature: Less than 5.0° C./s By setting an average heating rate within a temperature range of 500° C. to an $Ac_1$ transformation temperature in the first soaking treatment to less than 5.0° C./s, recrystallization of ferrite is promoted during heating, which makes it possible to obtain an equiaxial microstructure. As a result, since the resulting steel sheet has an equiaxial microstructure, the circularity index of quenched martensite is increased, improving stretch flangeability. When the average heating rate within a temperature range of 500° C. to an $Ac_1$ transformation temperature in the first soaking treatment is 5.0° C./s or more, recrystallization of ferrite is suppressed during heating and the resulting steel sheet has an elongated microstructure. Thus, the circularity index of quenched martensite is decreased, lowering stretch flangeability. Therefore, the average heating rate within a temperature range of 500° C. to an $Ac_1$ transformation temperature is set to less than 5.0° C./s and preferably less than 4.5° C./s. On the other hand, no lower limit is placed on the average heating rate within a temperature range of 500° C. to an $Ac_1$ transformation temperature, yet from the viewpoint of further improving strength and stretch flangeability, the average heating rate is preferably set to 0.5° C./s or more and more preferably 1.0° C./s or more.

First Soaking Temperature: T1 Temperature or Higher and T2 Temperature or Lower

First, the cold-rolled steel sheet is heated to the first soaking temperature of a T1 temperature or higher and a T2 temperature or lower. The T1 temperature is defined by the following formula (1):

$$T1\ \text{temperature}\ (^\circ\ \text{C.}) = 751 - 27\times[\%\ \text{C}] + 18\times[\%\ \text{Si}] - 12\times[\%\ \text{Mn}] - 169\times[\%\ \text{Al}] - 6\times[\%\ \text{Ti}] + 24\times[\%\ \text{Cr}] - 895\times[\%\ \text{B}] \quad (1),$$

and the T2 temperature is defined by the following formula (2):

$$T2\ \text{temperature}\ (^\circ\ \text{C.}) = 937 - 477\times[\%\ \text{C}] + 56\times[\%\ \text{Si}] - 20\times[\%\ \text{Mn}] + 198\times[\%\ \text{Al}] + 136\times[\%\ \text{Ti}] - 5\times[\%\ \text{Cr}] + 3315\times[\%\ \text{B}] \quad (2)$$

where brackets of the formula (1) and formula (2) indicate content by mass % of an element of the chemical composition enclosed in the brackets.

The T1 temperature defined by the formula (1) indicates a transformation start temperature from ferrite to austenite and the T2 temperature indicates a temperature at which a metallic microstructure becomes an austenite single phase. When the first soaking temperature is lower than the T1 temperature, a hard phase (quenched martensite, tempered temperature, and retained austenite) necessary for ensuring strength and ductility cannot be obtained. On the other hand, when the first soaking temperature is higher than the T2 temperature, ferrite necessary for ensuring good ductility is not contained. Therefore, the first soaking temperature is set to the T1 temperature or higher and the T2 temperature or lower, and annealing is performed in a ferrite-austenite dual phase region.

In the first soaking treatment, after the steel sheet reaches the first soaking treatment temperature, the steel sheet may be subjected to the subsequent cooling step, without being held at the temperature, yet from the viewpoint of controlling with high accuracy the area ratio of austenite, the steel sheet is preferably held at the temperature. When the steel sheet reaches the first soaking treatment temperature and is held at the temperature, the holding time (first holding time) is preferably set to 2 s or more and more preferably 5 s or more. On the other hand, though no upper limit is placed on the holding time, holding the steel sheet at the temperature for an excessively long time ends up causing the saturation of the effect and a reduction in productivity. Thus, the holding time is preferably set to 500 s or less and more preferably 300 s or less.

Average Cooling Rate in a Temperature Range Down to 500° C.: 10° C./s or More

Next, the cold-rolled steel sheet heated to the first soaking temperature is cooled. In the high-strength cold-rolled steel sheet of this disclosure, a predetermined area ratio of tempered martensite needs to be formed in order to ensure stretch flangeability. To form tempered martensite in the second soaking treatment described below, in the cooling of the first soaking treatment, the steel sheet needs to be cooled down to a martensite transformation start temperature or lower. However, when the average cooling rate within a temperature range of the first soaking temperature to 500° C. is less than 10° C./s, ferrite is excessively formed during cooling and carbon expelled from the ferrite is concentrated in untransformed austenite. The carbon stabilizes the austenite, and as a result, subsequent martensite transformation at a cooling stop temperature and bainite transformation during the second soaking treatment are not promoted, and ductility and stretch flangeability are lowered. Therefore, as cooling conditions in the first soaking treatment, the lower limit of the average cooling rate in a temperature range down to 500° C. is set to 10° C./s or more. On the other hand, no upper limit is placed on the average cooling rate in a temperature range down to 500° C., yet to form a predetermined amount of ferrite contributing to achievement of good ductility, the average cooling rate is preferably set to 100° C./s or less.

Cooling Stop Temperature: 100° C. to 250° C.

When the cooling stop temperature of the cooling in the first soaking treatment is lower than 100° C., the amount of untransformed austenite at the time of stopping the cooling is decreased and the amount of retained austenite in the resulting steel sheet is decreased, thus lowering ductility. Therefore, the cooling stop temperature is set to 100° C. or higher and preferably 130° C. or higher. On the other hand, when the cooling stop temperature is higher than 250° C., the amount of martensite at the time of stopping the cooling is decreased and the amount of tempered martensite in the resulting steel sheet is decreased, thus lowering stretch flangeability. Therefore, the cooling stop temperature is set to 250° C. or lower and preferably 220° C. or lower.

[Second Soaking Treatment]

Then, the cold-rolled steel sheet cooled in the first soaking treatment is subjected to a second soaking treatment. The second soaking treatment includes re-heating to a second soaking temperature, holding at the temperature and cooling.

Second Soaking Temperature: 350° C. to 500° C.

First, the cooled cold-rolled steel sheet is re-heated to the second soaking temperature and held at the second soaking temperature. In the second soaking treatment, quenched martensite formed in the cooling step of the first soaking treatment is tempered into tempered martensite. Further, carbon expelled when a part of untransformed austenite experiences bainite transformation is concentrated in untransformed austenite among bainite laths. The carbon stabilizes austenite, and as a result, retained austenite can be ensured in the resulting steel sheet. At that time, when the second soaking temperature is lower than 350° C., tempering of quenched martensite is insufficient and the area ratio of quenched martensite to the total area ratio of quenched martensite and tempered martensite is increased, thus lowering stretch flangeability. Therefore, the second soaking temperature is set to 350° C. or higher. On the other hand, when the second soaking temperature is higher than 500° C., austenite present at the time of stopping the cooling of the first soaking treatment is transformed into pearlite (ferrite and cementite), making it impossible to ensure that austenite remain as it is, thus lowering strength and ductility. Therefore, the second soaking temperature is set to 500° C. or lower.

Holding Time at the Second Soaking Temperature: 10 Seconds or More

Further, since when the holding (soaking) time in the second soaking treatment is less than 10 seconds, bainite transformation does not sufficiently progress and thus untransformed austenite excessively remains during the holding at the second soaking temperature, the area ratio of quenched martensite to the total area ratio of quenched martensite and tempered martensite is increased, and as result, stretch flangeability is lowered. Therefore, the holding time in the second soaking treatment is set to 10 seconds or more. On the other hand, no upper limit is placed on the holding time, yet holding the steel sheet for more than 1500 seconds does not affect the subsequent steel sheet microstructure and mechanical properties, and thus, the holding time is preferably set to 1500 seconds or less.

Average Cooling Rate in a Temperature Range Down to 200° C.: 50° C./s or Less

After the heating to a temperature range in which upper bainite is formed and the holding at the temperature range are completed, the steel sheet is cooled to a room temperature. At that time, the average cooling rate within a temperature range of a temperature at the completion of the second soaking treatment to 200° C. (hereinafter, referred to as "average cooling rate in a temperature range down to 200° C.") is set to 50° C./s or less. Satisfying the above conditions is very important in this disclosure.

When the average cooling rate in a temperature range down to 200° C. is more than 50° C./s, martensite formed during cooling is not self-tempered, and the area ratio of quenched martensite to the total area ratio of quenched martensite and tempered martensite is increased, thus lowering stretch flangeability. Therefore, the average cooling rate in a temperature range down to 200° C. is set to 50° C./s or less, preferably 30° C./s or less, and more preferably 15° C./s or less. Further, a residence time in a temperature range in which C is diffused is longer by setting the average cooling rate in a temperature range down to 200° C. to 50°

C./s or less, that is, relatively slowly cooling the steel sheet after soaking in the second soaking treatment. Therefore, C is diffused and concentrated in untransformed austenite existing around bainitic ferrite formed by bainite transformation and having an elongated shape (having a low circularity), and stabilized. As a result, austenite having an elongated shape selectively remains as retained austenite while only untransformed austenite existing separated from bainitic ferrite and having a high circularity becomes quenched martensite during cooling. Therefore, the circularity index of quenched martensite in the resulting steel sheet becomes 0.50 or more and stretch flangeability can be improved.

On the other hand, no lower limit is placed on the average cooling rate in a temperature range down to 200° C., yet an average cooling rate of less than 0.1° C./s does not significantly change the microstructure, and thus, the average cooling rate in a temperature range down to 200° C. is preferably set to 0.1° C./s or more.

The cooling conditions at a temperature lower than 200° C. does not affect the microstructure and mechanical properties of the resulting steel sheet, and thus, cooling can be performed under any conditions. From the viewpoint of decreasing the cooling time, water cooling is preferable.

EXAMPLES

Next, a more detailed description is given below based on examples. The following examples merely represent preferred examples, and this disclosure is not limited to these examples.

Steel samples having the chemical compositions listed in Table 1 were obtained by steelmaking and slabs having a sheet thickness of 20 mm were manufactured from the steel samples. The slabs were heated to the steel slab heating temperatures listed in Tables 2 and 3 and subsequently hot rolled to obtain hot-rolled steel sheet having a sheet thickness of 3 mm.

In the hot rolling, after rough rolling, finish rolling was performed at the finisher delivery temperatures listed in Tables 2 and 3. Next, the finish-rolled steel sheets were allowed to naturally cool, held at the coiling temperatures listed in Tables 2 and 3, and subsequently subjected to a treatment corresponding to coiling where furnace cooling was conducted. Then, the both surfaces of the obtained hot-rolled steel sheets were evenly ground on both sides to the thickness of 2.2 mm for descaling and subsequently cold rolled to the sheet thickness of 0.9 mm (rolling reduction: 59%) to obtain cold-rolled steel sheets.

Then, the cold-rolled steel sheets were heated to the first soaking temperatures listed in Tables 2 and 3 and subsequently cooled while strictly controlling the average cooling rate in a temperature range down to 500° C. to the values listed in Tables 2 and 3. The cooling was stopped at the cooling stop temperatures listed in Tables 2 and 3. After stopping the cooling, the cold-rolled steel sheets were immediately re-heated to the second soaking temperatures listed in Tables 2 and 3 and subjected to a soaking treatment whereby the cold-rolled steel sheets were held at the second soaking temperatures for the second holding times. Next, the cold-rolled steel sheets were cooled while strictly controlling the average cooling rate in a temperature range down to 200° C. to the values listed in Tables 2 and 3 and then cooled to a room temperature.

Each of the cold-rolled steel sheets obtained by the above steps was evaluated by the following method in terms of microstructure and mechanical properties.

(Microstructure)

The microstructure was observed with the use of a test piece collected from the steel sheet in a manner such that a cross section in a L direction (rolling direction) at the position of ¼ of a sheet thickness was an observation position. The test piece was obtained by mirror polishing the cross section in the L direction using an alumina buff and subsequently performing nital etching. An optical microscope and scanning electron microscope (SEM) were used for observation.

Further, to observe the internal microstructure of a hard phase in more detail, secondary electron images at a low accelerating voltage of 1 kV were observed using an in-Lens detector. A sample used for the observation was obtained by mirror polishing its L cross section using diamond paste, final polishing it using colloidal silica, and etching it using 3% natal. The reason of observing the sample at a low accelerating voltage was to clearly detect even a small irregularity corresponding to a fine microstructure exposed on a sample surface using nital at a low concentration.

For quenched martensite and tempered martensite, three fields within a range of 30 μm×40 μm were observed at 2000 times magnification, and for retained austenite, three fields within a range of 12 μm×16 μm were observed at 5000 times magnification. The obtained microstructure images were analyzed using an image analysis software ("particle analysis" Ver. 3 available from NIPPON STEEL TECHNOLOGY Co., Ltd.). The area ratio of each microstructure was calculated in the three fields by the analysis and the average value was determined. Further, a phase of the balance other than quenched martensite, tempered martensite, and retained austenite was made of ferrite. Therefore, the area ratio of ferrite was calculated by subtracting the area ratios of quenched martensite, tempered martensite, and retained austenite from 100.

Further, a perimeter D and an area M of each particle of quenched martensite within the range of 30 μm×40 μm were measured by the image analysis and the average values were determined. Using the average values, the circularity index ($4\pi M/D^2$) was calculated.

(Tensile Strength)

Test samples collected from the obtained steel sheets were used to conduct a tensile test, and yield stress (YS), tensile strength (TS), and total elongation (El) were measured. As the test samples, JIS No. 5 tensile test pieces (gauge length: 50 mm, width: 25 mm) were collected from the steel sheets in a C direction (direction perpendicular to a rolling direction). The test rate in the tensile test was 10 mm/min.

(Hole Expansion Ratio)

To evaluate stretch flangeability, a hole expanding test was performed in the following procedures to measure the hole expansion ratio (λ). First, test samples of 100 mm square were collected from the steel sheets. Next, a hole with a predetermined hole diameter ($D_0$) of 10 mm was punched through each test sample with a clearance of 11.1% using a punch having a diameter of 10 mm and a die having a diameter of 10.2 mm in accordance to JIS Z 2256. Next, the burr face of the test sample was directed upward and a hole expanding test was conducted using a conical punch having a vertex angle of 60° with a movement speed of 10 mm/min and the diameter of a hole (D) when a crack ran through the sheet thickness was measured. The obtained hole diameter (D) and the predetermined hole diameter ($D_0$) were used to calculate the hole expansion ratio (λ) according to the following formula (3):

$$\lambda(\%)=\{(D-D_0)/D_0\}\times 100 \quad (3)$$

Tables 4 and 5 list the metallic microstructure and the measurement results of yield stress (YS), yield strength (TS), total elongation (El), and hole expansion ratio (λ) of the steel sheets. Further, the product of TS and El (TS·El) as an index of ductility and the product of TS and λ (TS·λ) as an index of stretch flangeability are listed in Tables 4 and 5.

As can be seen from the results listed in Tables 4 and 5, the steel sheets of our examples satisfying the conditions of this disclosure, which had TS of 750 MPa or more, TS·El of 20000 MPa·% or more, and TS·λ of 30000 MPa·% or more, exhibited excellent ductility and stretch flangeability. In contrast, the steel sheets of the comparative examples not satisfying the conditions of this disclosure were inferior in terms of at least one of the strength, the total elongation, and the hole expansion ratio.

Although some embodiments of this disclosure have been described above, this disclosure is not limited by the description that forms a part of this disclosure in relation to the embodiments. That is, a person skilled in the art may make various modifications to the embodiments, examples, and operation techniques disclosed herein, and all such modifications will still fall within the scope of the claims which follow. For example, in the above-described series of heat treatment processes in the manufacturing method disclosed herein, any apparatus or the like may be used to perform the processes on the steel sheet as long as the thermal hysteresis conditions are met.

TABLE 1

| Steel sample | Chemical composition (mass %)* | | | | | | | | T1 temperature | T2 temperature | |
|---|---|---|---|---|---|---|---|---|---|---|---|
| ID | C | Si | Mn | P | S | Al | N | Other | (° C.) | (° C.) | Remarks |
| 1 | 0.052 | 1.28 | 2.75 | 0.017 | 0.0012 | 0.032 | 0.0041 | — | 734 | 935 | Comparative steel |
| 2 | 0.065 | 1.14 | 2.71 | 0.005 | 0.0015 | 0.046 | 0.0030 | — | 729 | 925 | Conforming steel |
| 3 | 0.074 | 1.11 | 2.65 | 0.012 | 0.0014 | 0.032 | 0.0054 | — | 732 | 917 | Conforming steel |
| 4 | 0.083 | 1.21 | 2.51 | 0.017 | 0.0019 | 0.031 | 0.0039 | — | 735 | 921 | Conforming steel |
| 5 | 0.191 | 1.29 | 1.53 | 0.017 | 0.0022 | 0.038 | 0.0056 | — | 744 | 895 | Conforming steel |
| 6 | 0.212 | 1.02 | 1.40 | 0.020 | 0.0014 | 0.047 | 0.0030 | Ti: 0.031 | 739 | 879 | Conforming steel |
| 7 | 0.243 | 1.10 | 1.15 | 0.008 | 0.0020 | 0.025 | 0.0027 | — | 746 | 865 | Conforming steel |
| 8 | 0.264 | 1.14 | 1.12 | 0.019 | 0.0020 | 0.039 | 0.0041 | — | 744 | 860 | Comparative steel |
| 9 | 0.232 | 1.10 | 0.92 | 0.015 | 0.0016 | 0.034 | 0.0031 | — | 748 | 876 | Comparative steel |
| 10 | 0.071 | 1.25 | 2.92 | 0.016 | 0.0019 | 0.034 | 0.0054 | — | 731 | 921 | Comparative steel |
| 11 | 0.176 | 0.62 | 2.50 | 0.010 | 0.0012 | 0.037 | 0.0049 | — | 721 | 845 | Comparative steel |
| 12 | 0.171 | 0.80 | 2.32 | 0.009 | 0.0015 | 0.027 | 0.0029 | — | 728 | 859 | Conforming steel |
| 13 | 0.161 | 0.95 | 2.16 | 0.019 | 0.0020 | 0.031 | 0.0033 | — | 733 | 876 | Conforming steel |
| 14 | 0.174 | 1.13 | 1.95 | 0.009 | 0.0016 | 0.039 | 0.0051 | Ti: 0.015 | 737 | 888 | Conforming steel |
| 15 | 0.165 | 1.41 | 1.74 | 0.007 | 0.0022 | 0.034 | 0.0048 | — | 745 | 909 | Conforming steel |
| 16 | 0.167 | 1.55 | 1.58 | 0.018 | 0.0022 | 0.044 | 0.0027 | — | 748 | 921 | Conforming steel |
| 17 | 0.128 | 1.70 | 1.95 | 0.019 | 0.0021 | 0.028 | 0.0038 | — | 750 | 938 | Conforming steel |
| 18 | 0.110 | 1.92 | 1.95 | 0.014 | 0.0009 | 0.049 | 0.0035 | — | 751 | 963 | Comparative steel |
| 19 | 0.161 | 1.30 | 2.03 | 0.013 | 0.0016 | 0.014 | 0.0055 | — | 743 | 895 | Conforming steel |
| 20 | 0.169 | 1.26 | 2.03 | 0.007 | 0.0022 | 0.063 | 0.0028 | — | 734 | 899 | Conforming steel |
| 21 | 0.180 | 1.23 | 1.97 | 0.017 | 0.0021 | 0.085 | 0.0032 | — | 730 | 897 | Conforming steel |
| 22 | 0.161 | 1.28 | 1.90 | 0.015 | 0.0016 | 0.111 | 0.0033 | — | 728 | 916 | Comparative steel |
| 23 | 0.163 | 1.15 | 2.01 | 0.009 | 0.0008 | 0.047 | 0.0037 | Mo: 0.42 | 735 | 893 | Conforming steel |
| 24 | 0.177 | 1.27 | 1.85 | 0.005 | 0.0019 | 0.050 | 0.0060 | Ti: 0.085 | 738 | 908 | Conforming steel |
| 25 | 0.168 | 1.28 | 2.05 | 0.013 | 0.0010 | 0.040 | 0.0036 | Nb: 0.041 | 738 | 895 | Conforming steel |
| 26 | 0.169 | 1.15 | 1.97 | 0.008 | 0.0014 | 0.037 | 0.0034 | V: 0088 | 737 | 889 | Conforming steel |
| 27 | 0.177 | 1.11 | 1.87 | 0.008 | 0.0020 | 0.034 | 0.0056 | B: 00087 | 730 | 913 | Conforming steel |
| 28 | 0.177 | 1.19 | 2.01 | 0.017 | 0.0020 | 0.027 | 0.0033 | Cr: 0.42 | 749 | 882 | Conforming steel |
| 29 | 0.164 | 1.30 | 1.97 | 0.009 | 0.0013 | 0.036 | 0.0034 | Cu: 0.90 | 740 | 899 | Conforming steel |
| 30 | 0.177 | 1.10 | 2.05 | 0.007 | 0.0019 | 0.043 | 0.0048 | Ni: 0.39 | 734 | 882 | Conforming steel |
| 31 | 0.174 | 1.18 | 1.90 | 0.018 | 0.0010 | 0.050 | 0.0040 | As: 0.472 | 736 | 892 | Conforming steel |
| 32 | 0.177 | 1.11 | 1.97 | 0.014 | 0.0016 | 0.047 | 0.0057 | Sb: 0.087 | 735 | 885 | Conforming steel |
| 33 | 0.168 | 1.29 | 2.00 | 0.010 | 0.0015 | 0.037 | 0.0032 | Sn: 0.094 | 739 | 896 | Conforming steel |
| 34 | 0.172 | 1.17 | 1.88 | 0.005 | 0.0017 | 0.037 | 0.0036 | Ta: 0.088 | 739 | 890 | Conforming steel |
| 35 | 0.179 | 1.29 | 2.04 | 0.012 | 0.0020 | 0.042 | 0.0026 | Ca: 0.0186 | 738 | 891 | Conforming steel |
| 36 | 0.175 | 1.10 | 1.89 | 0.018 | 0.0008 | 0.026 | 0.0057 | Mg: 0.0190 | 739 | 882 | Conforming steel |
| 37 | 0.180 | 1.15 | 1.88 | 0.010 | 0.0009 | 0.037 | 0.0026 | Zn: 0.016 | 738 | 885 | Conforming steel |
| 38 | 0.169 | 1.10 | 1.92 | 0.016 | 0.0010 | 0.034 | 0.0033 | Co: 0.015 | 737 | 886 | Conforming steel |
| 39 | 0.180 | 1.20 | 1.96 | 0.015 | 0.0017 | 0.030 | 0.0034 | Zr: 0.014 | 739 | 885 | Conforming steel |
| 40 | 0.169 | 1.17 | 1.93 | 0.008 | 0.0016 | 0.043 | 0.0053 | REM: 0.0189 | 737 | 892 | Conforming steel |

*The balance is Fe and inevitable impurities.

TABLE 2

| | | Heating | Hot rolling | | | First soaking treatment | | | | Second soaking treatment | | | |
|---|---|---|---|---|---|---|---|---|---|---|---|---|---|
| No. | Steel sample ID | Steel slab heating temperature (° C.) | Finisher delivery temperature (° C.) | Coiling temperature (° C.) | Cold rolling Rolling reduction (%) | Average heating rate from 500° C. to Ac1 temperature (° C./s) | First soaking temperature (° C.) | Average cooling rate down to 500° C. (° C./s) | Cooling stop temperature (° C.) | Second soaking temperature (° C.) | Holding time (s) | Average cooling rate down to 200° C. (° C./s) | Remarks |
| 1 | 1 | 1160 | 880 | 430 | 55 | 3.0 | 810 | 16 | 170 | 400 | 620 | 8 | Comparative example |
| 2 | 2 | 1130 | 860 | 600 | 40 | 3.0 | 850 | 19 | 170 | 440 | 240 | 12 | Example |
| 3 | 3 | 1130 | 850 | 360 | 60 | 2.0 | 820 | 26 | 150 | 440 | 200 | 34 | Example |
| 4 | 4 | 1240 | 920 | 360 | 55 | 3.0 | 820 | 20 | 170 | 420 | 1160 | 12 | Example |
| 5 | 5 | 1250 | 920 | 630 | 45 | 1.5 | 810 | 18 | 180 | 390 | 330 | 14 | Example |
| 6 | 6 | 1210 | 850 | 510 | 55 | 2.0 | 830 | 16 | 150 | 370 | 990 | 20 | Example |
| 7 | 7 | 1140 | 930 | 410 | 60 | 3.0 | 800 | 30 | 160 | 380 | 430 | 23 | Example |
| 8 | 8 | 1220 | 900 | 460 | 55 | 1.0 | 850 | 28 | 190 | 370 | 730 | 16 | Comparative example |
| 9 | 9 | 1270 | 850 | 510 | 45 | 3.0 | 830 | 31 | 160 | 410 | 590 | 13 | Comparative example |
| 10 | 10 | 1120 | 890 | 410 | 55 | 2.0 | 820 | 22 | 150 | 390 | 250 | 6 | Comparative example |
| 11 | 11 | 1150 | 860 | 480 | 55 | 1.0 | 850 | 24 | 190 | 420 | 430 | 8 | Comparative example |
| 12 | 12 | 1160 | 850 | 390 | 65 | 1.5 | 840 | 35 | 200 | 420 | 1060 | 30 | Example |
| 13 | 13 | 1210 | 910 | 430 | 40 | 1.5 | 820 | 19 | 160 | 420 | 590 | 15 | Example |
| 14 | 14 | 1200 | 920 | 420 | 55 | 3.0 | 810 | 24 | 180 | 380 | 150 | 20 | Example |
| 15 | 4 | 1050 | 910 | 490 | 55 | 2.0 | 810 | 32 | 190 | 390 | 600 | 23 | Comparative example |
| 16 | 5 | 1250 | 780 | 460 | 55 | 1.0 | 810 | 31 | 160 | 440 | 410 | 5 | Comparative example |
| 17 | 13 | 1240 | 990 | 510 | 45 | 3.0 | 810 | 29 | 190 | 430 | 760 | 21 | Comparative example |
| 18 | 15 | 1270 | 860 | 270 | 55 | 3.0 | 840 | 16 | 160 | 430 | 870 | 30 | Comparative example |
| 19 | 4 | 1260 | 910 | 730 | 55 | 2.0 | 850 | 31 | 200 | 450 | 820 | 32 | Comparative example |
| 20 | 5 | 1180 | 930 | 410 | 55 | 1.5 | 700 | 28 | 180 | 370 | 900 | 17 | Comparative example |
| 21 | 13 | 1240 | 900 | 460 | 60 | 1.0 | 930 | 30 | 200 | 450 | 1190 | 24 | Comparative example |
| 22 | 14 | 1200 | 890 | 580 | 45 | 3.0 | 800 | 5 | 160 | 380 | 770 | 22 | Comparative example |
| 23 | 15 | 1160 | 860 | 530 | 50 | 1.0 | 820 | 60 | 190 | 390 | 340 | 20 | Example |
| 24 | 2 | 1130 | 850 | 420 | 55 | 3.0 | 810 | 23 | 40 | 390 | 740 | 13 | Comparative example |
| 25 | 14 | 1280 | 880 | 620 | 55 | 3.0 | 850 | 16 | 410 | 410 | 1100 | 34 | Comparative example |
| 26 | 4 | 1180 | 850 | 450 | 60 | 1.0 | 840 | 15 | 180 | 330 | 420 | 11 | Comparative example |
| 27 | 5 | 1140 | 920 | 480 | 55 | 1.5 | 830 | 34 | 200 | 550 | 630 | 8 | Comparative example |
| 28 | 13 | 1240 | 850 | 440 | 55 | 3.0 | 840 | 33 | 190 | 440 | 5 | 23 | Comparative example |
| 29 | 14 | 1200 | 900 | 480 | 45 | 1.0 | 830 | 27 | 180 | 440 | 510 | 53 | Comparative example |
| 30 | 15 | 1150 | 920 | 590 | 55 | 3.0 | 800 | 18 | 200 | 380 | 340 | 20 | Example |

TABLE 3

| | | Heating | Hot rolling | | | First soaking treatment | | | | Second soaking treatment | | | |
|---|---|---|---|---|---|---|---|---|---|---|---|---|---|
| No. | Steel sample ID | Steel slab heating temperature (° C.) | Finisher delivery temperature (° C.) | Coiling temperature (° C.) | Cold rolling Rolling reduction (%) | Average heating rate from 500° C. to Ac1 temperature (° C./s) | First soaking temperature (° C.) | Average cooling rate down to 500° C. (° C./s) | Cooling stop temperature (° C.) | Second soaking temperature (° C.) | Holding time (s) | Average cooling rate down to 200° C. (° C./s) | Remarks |
| 31 | 14 | 1200 | 920 | 550 | 35 | 2.0 | 820 | 26 | 180 | 390 | 220 | 15 | Example |
| 32 | 14 | 1200 | 920 | 550 | 65 | 0.5 | 820 | 26 | 180 | 390 | 220 | 15 | Example |
| 33 | 14 | 1150 | 890 | 510 | 20 | 1.5 | 800 | 22 | 200 | 380 | 340 | 22 | Comparative example |
| 34 | 14 | 1150 | 890 | 510 | 45 | 15.0 | 800 | 22 | 200 | 380 | 340 | 22 | Comparative example |
| 35 | 16 | 1270 | 860 | 580 | 50 | 3.0 | 830 | 23 | 200 | 400 | 1020 | 7 | Example |
| 36 | 17 | 1140 | 870 | 390 | 65 | 1.5 | 850 | 32 | 150 | 410 | 1150 | 15 | Example |
| 37 | 18 | 1280 | 850 | 440 | 50 | 2.0 | 810 | 26 | 190 | 440 | 350 | 21 | Comparative example |
| 38 | 19 | 1130 | 870 | 550 | 45 | 4.0 | 800 | 22 | 200 | 380 | 1010 | 31 | Example |
| 39 | 20 | 1210 | 930 | 460 | 50 | 2.0 | 840 | 24 | 150 | 390 | 940 | 7 | Example |
| 40 | 21 | 1260 | 860 | 360 | 55 | 2.5 | 820 | 27 | 150 | 420 | 1140 | 27 | Example |
| 41 | 22 | 1270 | 920 | 530 | 50 | 2.0 | 850 | 18 | 160 | 410 | 170 | 30 | Comparative example |
| 42 | 23 | 1130 | 890 | 600 | 50 | 2.0 | 820 | 15 | 150 | 380 | 900 | 18 | Example |
| 43 | 24 | 1250 | 870 | 470 | 45 | 1.5 | 840 | 24 | 170 | 370 | 740 | 27 | Example |
| 44 | 25 | 1240 | 860 | 390 | 55 | 2.5 | 830 | 20 | 170 | 400 | 650 | 32 | Example |
| 45 | 26 | 1240 | 860 | 390 | 50 | 2.0 | 850 | 32 | 200 | 380 | 570 | 33 | Example |
| 46 | 27 | 1170 | 910 | 360 | 50 | 2.0 | 820 | 22 | 160 | 430 | 480 | 28 | Example |
| 47 | 28 | 1140 | 910 | 570 | 45 | 3.0 | 840 | 19 | 200 | 420 | 320 | 13 | Example |
| 48 | 29 | 1220 | 870 | 510 | 55 | 2.5 | 800 | 32 | 200 | 380 | 430 | 10 | Example |
| 49 | 30 | 1150 | 890 | 520 | 50 | 2.0 | 800 | 28 | 180 | 440 | 550 | 25 | Example |
| 50 | 31 | 1200 | 910 | 410 | 45 | 2.0 | 820 | 32 | 170 | 420 | 270 | 11 | Example |
| 51 | 32 | 1260 | 870 | 360 | 60 | 1.5 | 810 | 15 | 200 | 420 | 1030 | 35 | Example |
| 52 | 33 | 1160 | 870 | 590 | 50 | 2.0 | 830 | 25 | 160 | 430 | 970 | 19 | Example |
| 53 | 34 | 1230 | 930 | 440 | 50 | 2.0 | 840 | 31 | 190 | 420 | 360 | 25 | Example |
| 54 | 35 | 1190 | 890 | 460 | 45 | 2.5 | 850 | 23 | 200 | 390 | 840 | 25 | Example |
| 55 | 36 | 1280 | 890 | 480 | 55 | 0.5 | 810 | 28 | 200 | 440 | 470 | 18 | Example |
| 56 | 37 | 1200 | 880 | 550 | 50 | 2.0 | 840 | 24 | 150 | 430 | 1000 | 30 | Example |
| 57 | 38 | 1150 | 850 | 530 | 45 | 2.5 | 810 | 30 | 150 | 390 | 1050 | 28 | Example |
| 58 | 39 | 1270 | 900 | 610 | 55 | 1.5 | 830 | 20 | 180 | 380 | 160 | 34 | Example |
| 59 | 40 | 1200 | 930 | 540 | 50 | 3.0 | 830 | 20 | 170 | 370 | 910 | 30 | Example |
| 60 | 14 | 1150 | 920 | 590 | 55 | 4.5 | 800 | 18 | 200 | 380 | 340 | 20 | Example |
| 61 | 14 | 1150 | 920 | 590 | 55 | 6.0 | 800 | 18 | 200 | 380 | 340 | 20 | Comparative example |

TABLE 4

| | | Microstructure of steel sheet* | | | | | | | | Mechanical properties | | | | | | |
|---|---|---|---|---|---|---|---|---|---|---|---|---|---|---|---|---|
| | | F | M | | | RA | TM | | | | | | | | | |
| No. | Steel sample ID | Area ratio (%) | Area ratio (%) | Average grain size (μm) | Average circularity index | Area ratio (%) | Area ratio (%) | Balance | $f_M/f_{M+TM}$ (%) | YS (MPa) | TS (MPa) | El (%) | λ (%) | TS · El (MPa · %) | TS · λ (MPa · %) | Remarks |
| 1 | 1 | 88 | 5 | 1.0 | 0.72 | 5 | 2 | — | 29 | 562 | 738 | 22 | 35 | 16236 | 30520 | Comparative example |
| 2 | 2 | 68 | 8 | 1.2 | 0.68 | 6 | 18 | — | 31 | 549 | 864 | 24 | 37 | 20736 | 31968 | Example |
| 3 | 3 | 69 | 7 | 1.4 | 0.65 | 7 | 17 | — | 29 | 535 | 861 | 25 | 39 | 21525 | 33579 | Example |
| 4 | 4 | 70 | 6 | 1.5 | 0.64 | 8 | 16 | — | 27 | 525 | 850 | 26 | 41 | 22100 | 34850 | Example |
| 5 | 5 | 71 | 5 | 1.8 | 0.56 | 11 | 13 | — | 28 | 497 | 827 | 27 | 41 | 22329 | 33907 | Example |
| 6 | 6 | 73 | 5 | 2.0 | 0.54 | 12 | 10 | — | 33 | 489 | 805 | 28 | 41 | 22540 | 33005 | Example |
| 7 | 7 | 76 | 5 | 2.2 | 0.53 | 13 | 6 | — | 45 | 481 | 799 | 28 | 39 | 22372 | 31161 | Example |
| 8 | 8 | 80 | 8 | 2.3 | 0.52 | 11 | 1 | — | 43 | 459 | 805 | 25 | 37 | 20125 | 29785 | Comparative example |
| 9 | 9 | 92 | 1 | 2.1 | 0.51 | 6 | 1 | — | 48 | 429 | 738 | 30 | 41 | 22140 | 30258 | Comparative example |
| 10 | 10 | 70 | 9 | 1.1 | 0.55 | 6 | 15 | — | 38 | 550 | 861 | 24 | 33 | 20664 | 28413 | Comparative example |
| 11 | 11 | 71 | 7 | 1.9 | 0.58 | 5 | 17 | θ | 29 | 549 | 843 | 23 | 39 | 19389 | 32877 | Comparative example |
| 12 | 12 | 71 | 7 | 1.7 | 0.62 | 6 | 16 | — | 30 | 538 | 841 | 24 | 40 | 20184 | 33640 | Example |
| 13 | 13 | 70 | 6 | 1.5 | 0.61 | 8 | 16 | — | 27 | 521 | 837 | 26 | 42 | 21762 | 35154 | Example |
| 14 | 14 | 70 | 5 | 1.2 | 0.64 | 10 | 15 | — | 25 | 517 | 834 | 27 | 45 | 22518 | 37530 | Example |
| 15 | 4 | 73 | 6 | 1.5 | 0.42 | 6 | 15 | — | 29 | 504 | 848 | 24 | 35 | 20352 | 29680 | Comparative example |
| 16 | 5 | 81 | 6 | 1.2 | 0.45 | 8 | 5 | — | 45 | 446 | 771 | 28 | 35 | 21588 | 26985 | Comparative example |
| 17 | 13 | 91 | 1 | 2.3 | 0.57 | 6 | 2 | — | 47 | 520 | 745 | 27 | 41 | 20115 | 30545 | Comparative example |
| 18 | 15 | 68 | 7 | 0.6 | 0.45 | 12 | 13 | — | 35 | 483 | 880 | 23 | 30 | 20240 | 26400 | Comparative example |
| 19 | 4 | 91 | 2 | 2.3 | 0.52 | 6 | 1 | — | 48 | 436 | 746 | 31 | 41 | 23126 | 30586 | Comparative example |
| 20 | 5 | 92 | 1 | 2.0 | 0.53 | 4 | 3 | — | 33 | 441 | 732 | 26 | 42 | 19032 | 30744 | Comparative example |
| 21 | 13 | 38 | 5 | 0.8 | 0.53 | 5 | 52 | — | 11 | 753 | 981 | 15 | 53 | 14715 | 51993 | Comparative example |
| 22 | 14 | 91 | 4 | 1.4 | 0.65 | 3 | 2 | — | 45 | 406 | 764 | 26 | 35 | 19864 | 26740 | Comparative example |
| 23 | 15 | 68 | 5 | 0.8 | 0.67 | 8 | 19 | — | 21 | 525 | 862 | 25 | 36 | 21550 | 31032 | Example |
| 24 | 2 | 68 | 0 | — | — | 2 | 30 | — | 0 | 592 | 861 | 20 | 50 | 17220 | 43050 | Comparative example |
| 25 | 14 | 76 | 12 | 1.7 | 0.58 | 10 | 2 | — | 40 | 499 | 823 | 27 | 30 | 22221 | 24690 | Comparative example |
| 26 | 4 | 71 | 8 | 2.3 | 0.51 | 6 | 15 | — | 63 | 756 | 1011 | 20 | 28 | 20220 | 28308 | Comparative example |
| 27 | 5 | 79 | 2 | 0.6 | 0.62 | 2 | 11 | P | 40 | 406 | 722 | 21 | 50 | 15162 | 36100 | Comparative example |
| 28 | 13 | 74 | 8 | 2.2 | 0.58 | 7 | 11 | — | 54 | 541 | 864 | 27 | 33 | 23328 | 28512 | Comparative example |
| 29 | 14 | 78 | 7 | 2.1 | 0.55 | 10 | 5 | — | 71 | 467 | 846 | 31 | 30 | 26226 | 25380 | Comparative example |
| 30 | 15 | 69 | 5 | 1.3 | 0.56 | 12 | 14 | — | 26 | 513 | 840 | 28 | 43 | 23520 | 36120 | Example |

*F: Ferrite, M: quenched martensite, TM: tempered martensite, RA: retained austensite, P: perlite, θ: cementite

TABLE 5

| | | Microstructure of steel sheet* | | | | | | | | Mechanical properties | | | | | | |
|---|---|---|---|---|---|---|---|---|---|---|---|---|---|---|---|---|
| | | F | M | | | RA | TM | | | | | | | | | |
| No. | Steel sample ID | Area ratio (%) | Area ratio (%) | Average grain size (μm) | Average circularity index | Area ratio (%) | Area ratio (%) | Balance | $f_M/f_{M+TM}$ (%) | YS (MPa) | TS (MPa) | El (%) | λ (%) | TS · El (MPa · %) | TS · λ (MPa · %) | Remarks |
| 31 | 14 | 53 | 6 | 1.6 | 0.55 | 13 | 28 | — | 28 | 515 | 863 | 27 | 36 | 23301 | 31068 | Example |
| 32 | 14 | 57 | 6 | 1.3 | 0.73 | 12 | 25 | — | 26 | 507 | 855 | 24 | 42 | 20520 | 35910 | Example |
| 33 | 14 | 66 | 8 | 1.8 | 0.38 | 8 | 18 | — | 35 | 488 | 826 | 30 | 34 | 24780 | 28084 | Comparative example |
| 34 | 14 | 64 | 8 | 2.1 | 0.41 | 9 | 19 | — | 40 | 495 | 809 | 29 | 35 | 23461 | 28315 | Comparative example |

TABLE 5-continued

| | | Microstructure of steel sheet* | | | | | | | | Mechanical properties | | | | | | |
|---|---|---|---|---|---|---|---|---|---|---|---|---|---|---|---|---|
| | | F | M | | | RA | TM | | | | | | | | | |
| No. | Steel sample ID | Area ratio (%) | Area ratio (%) | Average grain size (μm) | Average circularity index | Area ratio (%) | Area ratio (%) | Balance | $f_M/f_{M+TM}$ (%) | YS (MPa) | TS (MPa) | El (%) | λ (%) | TS · El (MPa · %) | TS · λ (MPa · %) | Remarks |
| 35 | 16 | 70 | 5 | 1.5 | 0.59 | 12 | 13 | — | 28 | 510 | 846 | 27 | 42 | 22842 | 35532 | Example |
| 36 | 17 | 70 | 5 | 1.7 | 0.56 | 11 | 14 | — | 26 | 511 | 853 | 25 | 44 | 21325 | 37532 | Example |
| 37 | 18 | 63 | 6 | 2.1 | 0.57 | 17 | 14 | — | 30 | 508 | 863 | 27 | 33 | 23301 | 28479 | Comparative example |
| 38 | 19 | 70 | 6 | 1.2 | 0.60 | 9 | 15 | — | 29 | 510 | 840 | 26 | 43 | 21840 | 36120 | Example |
| 39 | 20 | 70 | 4 | 1.0 | 0.71 | 12 | 14 | — | 22 | 502 | 838 | 28 | 41 | 23464 | 34358 | Example |
| 40 | 21 | 70 | 3 | 0.9 | 0.65 | 14 | 13 | — | 19 | 510 | 826 | 30 | 38 | 24780 | 31388 | Example |
| 41 | 22 | 72 | 7 | 0.8 | 0.63 | 16 | 5 | — | 48 | 518 | 815 | 32 | 35 | 26080 | 28525 | Comparative example |
| 42 | 23 | 70 | 6 | 1.5 | 0 66 | 11 | 13 | — | 32 | 513 | 832 | 25 | 40 | 20800 | 33280 | Example |
| 43 | 24 | 71 | 6 | 1.6 | 0.69 | 11 | 12 | — | 33 | 520 | 832 | 29 | 47 | 24128 | 39104 | Example |
| 44 | 25 | 72 | 7 | 1.4 | 0.66 | 10 | 11 | — | 39 | 526 | 834 | 25 | 40 | 20850 | 33360 | Example |
| 45 | 26 | 69 | 7 | 1.4 | 0.62 | 11 | 13 | — | 35 | 515 | 824 | 26 | 48 | 21424 | 39552 | Example |
| 46 | 27 | 72 | 6 | 1.2 | 0.57 | 11 | 11 | — | 35 | 510 | 823 | 27 | 50 | 22221 | 41150 | Example |
| 47 | 28 | 69 | 6 | 1.9 | 0.61 | 12 | 13 | — | 32 | 524 | 828 | 26 | 47 | 21528 | 38916 | Example |
| 48 | 29 | 71 | 7 | 1.3 | 0.65 | 10 | 12 | — | 37 | 520 | 822 | 28 | 45 | 23016 | 36990 | Example |
| 49 | 30 | 69 | 6 | 1.0 | 0.70 | 12 | 13 | — | 32 | 513 | 824 | 26 | 40 | 21424 | 32960 | Example |
| 50 | 31 | 73 | 5 | 1.7 | 0.65 | 10 | 12 | — | 29 | 521 | 821 | 26 | 42 | 21346 | 34482 | Example |
| 51 | 32 | 72 | 5 | 1.4 | 0.65 | 11 | 12 | — | 29 | 530 | 837 | 27 | 50 | 22599 | 41850 | Example |
| 52 | 33 | 72 | 7 | 1.5 | 0.55 | 11 | 10 | — | 41 | 513 | 820 | 26 | 40 | 21320 | 32800 | Example |
| 53 | 34 | 71 | 6 | 1.3 | 0.58 | 11 | 12 | — | 33 | 523 | 826 | 26 | 47 | 21476 | 38822 | Example |
| 54 | 35 | 72 | 6 | 1.5 | 0.58 | 12 | 10 | — | 38 | 522 | 829 | 28 | 49 | 23212 | 40621 | Example |
| 55 | 36 | 70 | 7 | 1.4 | 0.55 | 11 | 12 | — | 37 | 514 | 837 | 27 | 42 | 22599 | 35154 | Example |
| 56 | 37 | 70 | 5 | 1.6 | 0.62 | 12 | 13 | — | 28 | 527 | 833 | 28 | 49 | 23324 | 40817 | Example |
| 57 | 38 | 70 | 5 | 1.4 | 0.66 | 12 | 13 | — | 28 | 526 | 822 | 28 | 47 | 23016 | 38634 | Example |
| 58 | 39 | 72 | 6 | 1.4 | 0.68 | 10 | 12 | — | 33 | 510 | 834 | 27 | 44 | 22518 | 36696 | Example |
| 59 | 40 | 72 | 7 | 1.9 | 0 58 | 11 | 10 | — | 41 | 518 | 837 | 29 | 46 | 24273 | 38502 | Example |
| 60 | 14 | 65 | 6 | 1.3 | 0.52 | 11 | 18 | — | 41 | 524 | 849 | 26 | 36 | 22074 | 30564 | Example |
| 61 | 14 | 58 | 7 | 1.7 | 0.46 | 9 | 26 | — | 41 | 546 | 862 | 24 | 34 | 20688 | 29308 | Comparative example |

*F: Ferrite, M: quenched martensite, TM: tempered martensite, RA: retained austensite, P: perlite, θ: cementite

The invention claimed is:

1. A high-strength cold-rolled steel sheet comprising: a chemical composition containing, in mass %, C: 0.060% to 0.250%,
Si: 0.70% to 1.80%,
Mn: 1.00% to 2.80%,
P: 0.100% or less,
S: 0.0100% or less,
Al: 0.010% to 0.100%, and
N: 0.0100% or less,
with the balance being Fe and inevitable impurities, wherein the high-strength cold-rolled steel sheet has a microstructure consisting of, in percent by area, ferrite: 57% to 90%,
quenched martensite: 1% to 8%,
tempered martensite: 3% to 40%, and
retained austenite: 6% to 15%, the quenched martensite has an average grain size of 2.5 μm or less, the quenched martensite has an average circularity index of 0.50 to 1.00, the circularity index being defined as $4\pi M/D^2$, where D is a perimeter of the quenched martensite and M is an area of the quenched martensite, and the high-strength cold-rolled steel sheet has a ratio of an area ratio of the quenched martensite $f_M$ to a total area ratio of the quenched martensite and the tempered martensite $f_{M+TM}$, $f_M/f_{M+TM}$, of 0 to 0.50.

2. The high-strength cold-rolled steel sheet according to claim 1, wherein the chemical composition further contains, in mass %, at least one selected from the group consisting of:

Mo: 0.50% or less,
Ti: 0.100% or less,
Nb: 0.050% or less,
V: 0.100% or less,
B: 0.0100% or less,
Cr: 0.50% or less,
Cu: 1.00% or less,
Ni: 0.50% or less,
As: 0.500% or less,
Sb: 0.100% or less,
Sn: 0.100% or less,
Ta: 0.100% or less,
Ca: 0.0200% or less,
Mg: 0.0200% or less,
Zn: 0.020% or less,
Co: 0.020% or less,
Zr: 0.020% or less, and
REM: 0.0200% or less.

3. A method for manufacturing a high-strength cold-rolled steel sheet according to claim 1, comprising:

heating a steel slab having the chemical composition according to claim 1 to a steel slab heating temperature of 1100° C. to 1300° C. to obtain a heated steel slab, hot rolling the heated steel slab with a finisher delivery temperature of 800° C. to 950° C., a coiling temperature of 300° C. to 700° C. to obtain a hot-rolled steel sheet, cold rolling the hot-rolled steel sheet with a rolling reduction of 30% or more to obtain a cold-rolled steel sheet, subjecting the cold-rolled steel sheet to a first soaking treatment, whereby the cold-rolled steel sheet is heated under conditions of a first soaking temperature of a T1 temperature or higher and a T2 temperature or lower and an average heating rate of less than 5.0 ° C./s within a temperature range of 500° C. to an $Ac_1$ transformation temperature and subsequently cooled to a cooling stop temperature of 100° C. to 250° C. with an average cooling rate of 10° C./s or more in a temperature range down to 500° C., and subjecting the cold-rolled steel sheet after the first soaking treatment to a second soaking treatment, whereby the cold-rolled steel sheet is re-heated to a second soaking temperature of 350° C. to 500° C., held at the second soaking temperature for 10 seconds or more, subsequently cooled to 200° C. with an average cooling rate of 50° C./s or less, and then cooled to a room temperature, the T1 temperature being defined by the following formula (1):

$$T1 \text{ temperature } (^\circ \text{ C.}) = 751 - 27\times[\%\ C] + 18\times[\%\ Si] - 12\times[\%\ Mn] - 169\times[\%\ Al] - 6\times[\%\ Ti] + 24\times[\%\ Cr] - 895\times[\%\ B] \quad (1)$$

the T2 temperature being defined by the following formula (2):

$$T2 \text{ temperature } (^\circ \text{ C.}) = 937 - 477\times[\%\ C] + 56\times[\%\ Si] - 20\times[\%\ Mn] + 198\times[\%\ Al] + 136\times[\%\ Ti] - 5\times[\%\ Cr] + 3315\times[\%\ B] \quad (2)$$

where brackets of the formula (1) and formula (2) indicate content by mass % of an element of the chemical composition enclosed in the brackets.

4. A method for manufacturing a high-strength cold-rolled steel sheet according to claim 2, comprising:

heating a steel slab having the chemical composition according to claim 2 to a steel slab heating temperature of 1100° C. to 1300° C. to obtain a heated steel slab, hot rolling the heated steel slab with a finisher delivery temperature of 800° C. to 950° C., a coiling temperature of 300° C. to 700° C. to obtain a hot-rolled steel sheet, cold rolling the hot-rolled steel sheet with a rolling reduction of 30% or more to obtain a cold-rolled steel sheet, subjecting the cold-rolled steel sheet to a first soaking treatment, whereby the cold-rolled steel sheet is heated under conditions of a first soaking temperature of a T1 temperature or higher and a T2 temperature or lower and an average heating rate of less than 5.0° C./s within a temperature range of 500° C. to an $Ac_1$ transformation temperature and subsequently cooled to a cooling stop temperature of 100° C. to 250° C. with an average cooling rate of 10° C./s or more in a temperature range down to 500° C., and subjecting the cold-rolled steel sheet after the first soaking treatment to a second soaking treatment, whereby the cold-rolled steel sheet is re-heated to a second soaking temperature of 350° C. to 500° C., held at the second soaking temperature for 10 seconds or more, subsequently cooled to 200° C. with an average cooling rate of 50° C./s or less, and then cooled to a room temperature, the T1 temperature being defined by the following formula (1):

$$T1 \text{ temperature } (^\circ \text{ C.}) = 751 - 27\times[\%\ C] + 18\times[\%\ Si] - 12\times[\%\ Mn] - 169\times[\%\ Al] - 6\times[\%\ Ti] + 24\times[\%\ Cr] - 895\times[\%\ B] \quad (1)$$

the T2 temperature being defined by the following formula (2):

$$T2 \text{ temperature } (^\circ \text{ C.}) = 937 - 477\times[\%\ C] + 56\times[\%\ Si] - 20\times[\%\ Mn] + 198\times[\%\ Al] + 136\times[\%\ Ti] - 5\times[\%\ Cr] + 3315\times[\%\ B] \quad (2)$$

where brackets of the formula (1) and formula (2) indicate content by mass % of an element of the chemical composition enclosed in the brackets.

* * * * *